United States Patent [19]

Balz

[11] 4,413,448

[45] Nov. 8, 1983

[54] SELF-SEPARATING FINISHING MACHINE HAVING VARIABLE DEGREES OF ROTATION AND VIBRATION, AND METHOD

[75] Inventor: Gunther W. Balz, Kalamazoo, Mich.

[73] Assignee: Roto-Finish Company, Inc., Kalamazoo, Mich.

[21] Appl. No.: 419,973

[22] Filed: Sep. 20, 1982

Related U.S. Application Data

[62] Division of Ser. No. 264,399, May 18, 1981, Pat. No. 4,380,137.

[51] Int. Cl.[3] ..... B24B 1/00

[52] U.S. Cl. ..... 51/313

[58] Field of Search ..... 51/163.1, 163.2, 164 R, 51/313

[56] References Cited

U.S. PATENT DOCUMENTS

| | | | |
|---|---|---|---|
| 1,460,731 | 7/1923 | Pickop | 51/164.1 |
| 2,290,036 | 7/1942 | Davis | 51/164.1 |
| 3,073,080 | 1/1963 | Balz | 51/163.1 |
| 3,073,081 | 1/1963 | Balz | 51/163.1 |
| 3,073,082 | 1/1963 | Balz | 51/163.1 |
| 3,608,388 | 9/1971 | Huber | 51/163.2 |
| 3,877,178 | 4/1975 | Campanelli | 51/163.2 |
| 4,026,075 | 5/1977 | Balz | 51/313 |
| 4,042,181 | 8/1977 | Huber | 51/163.1 |
| 4,177,608 | 12/1979 | Balz | 51/163.2 |

*Primary Examiner*—Harold D. Whitehead

*Attorney, Agent, or Firm*—Gordon W. Hueschen

[57] ABSTRACT

A self-separating finishing machine for finishing of parts with finishing media, having a rotatable housing comprising a finishing chamber and a storage chamber and a foraminous member therebetween, wherein the housing is rotatable from a first and finishing position to a second and media-separating position and to a third and parts-ejection position, and wherein vibratory means, preferably variable-intensity vibratory means, is operatively associated with said foraminous member for vibration of said foraminous member, especially at different intensities, when said housing is in different positions of rotation, such machine embodying a particularly advantageous type of variable-intensity vibratory motor especially adapted for use in such machine, and a method of finishing involving the impartation of various intensities of vibration to the foraminous member at different stages of the process, e.g., when the housing is in different positions of rotation, are disclosed.

2 Claims, 9 Drawing Figures

SELF-SEPARATING FINISHING MACHINE HAVING VARIABLE DEGREES OF ROTATION AND VIBRATION, AND METHOD

This is a division of application Ser. No. 264,399, filed May 18, 1981 and now U.S. Pat. No. 4,380,137 issued Apr. 19, 1983.

BACKGROUND OF THE INVENTION

1. Field of the Invention

Finishing machines or apparatus, semi-automatic or batch-type, self-separating, of vibratory, gyratory, or spinner type, having various positions of rotation of the finishing machine housing and means for imparting vibration to the housing in different positions of rotation, which vibrations may be of different intensities, for assisting with separation of media from parts and with ejection of finished parts from the machine.

2. Prior Art

Numerous self-separating finishing devices of the automatic, semi-automatic, and batch-type have previously been proposed. These have mainly been of the vibratory or gyratory type. Recently I have developed such machines embodying a vertical centrifugal finishing unit as the finishing component thereof, which are the subject matter of my copending United States patent application Ser. No. 238,443, filed Feb. 26, 1981, now U.S. Pat. No. 4,363,194 dated Dec. 14, 1982. Whereas, in such vibratory or gyratory type of apparatus which was rotatable about an axis for separation employing a foraminous member or the like, the vibratory motor employed for the finishing operation was primarily located for effecting the finishing process and not for the separation step, leading to gross inefficiency in separation even when the vibratory means was actuated or continued in operation during the separation step, in my latest self-separating rotatable finishing machines, which embody a vertical centrifugal finishing unit, I have provided for independent vibratory means operatively associated with the foraminous member for imparting vibrations to the foraminous member during a combined parts separation and exit cycle, thus greatly improving the efficiency of the machine with respect to that aspect of its operation. However, regardless of whether the method of finishing employed is vibratory, gyratory, or of vertical centrifugal nature, differences in the character and nature of the parts being finished, and of the particular operation involved, make it highly desirable that machines of the type involved have greater flexibility to more readily enable an individualized treatment of a particular finishing problem, for example, particular finishing of particular parts with particular finishing media, particular conditions for separation of the media employed from the parts involved, and particular conditions during exit of the particular parts from the machine. Although it is common to employ particularized finishing media for the finishing of particular parts according to predetermined finishing program, up until the present time there has been neither apparatus or method available which permitted an individualized media-separation mode and an individualized parts-exit mode nor, to the best of my knowledge, has any such apparatus or method been previously proposed. More specifically, there has previously not been available any such apparatus or method whereby parts could be finished, whether by a vibratory, gyratory, or vertical centrifugal procedure, the finishing media and parts then separated from each other under controlled vibration conditions, and the separated finished parts then exited from the machine, again under controlled vibration conditions, which vibration conditions in the media-separation and parts-exit steps may, if desired, be varied to suit the individual type and nature of the part being treated, for example, gentle vibrations when fragile or breakable parts are involved, more vigorous vibrations when the parts are more durable and less subject to damage, or a combination of the two, for example, less intense vibrations during separation of media from parts and more intense vibrations for a more rapid exit of finished parts from the machine. Moreover, to the best of my knowledge, no machine of the type here involved having separate rotational positions for finishing, media separation, and parts exit has either been proposed or provided, much less such a machine comprising independent vibratory means associated with the foraminous member for operation in separate media-separation and parts exit steps, and still much less such apparatus or method wherein the vibrations in the various steps, phases, or cycles could be varied in their intensity. It is apparent that such improved finishing machine and method, not characterized by such stated inherent shortcomings, difficiencies, and inabilities of the prior art systems, would be highly desirable and would fulfill a long-felt and important need in the art. Such apparatus and method is provided by the present invention.

As representative of the prior art applicable to the particular area or areas of the surface-finishing field in which the present invention is made, may be mentioned U.S. Pat. Nos. 3,073,078, 3,073,079, 3,073,080, 3,073,081, 3,073,082, 3,073,069, 3,435,564, 3,990,188, 4,026,075, 4,177,608, and U.S. RE 29,964.

OBJECTS OF THE INVENTION

The present invention has the following objects, inter alia:

To provide a novel finishing machine of the semi-automatic or batch type, which may embody as the finishing element thereof either vibrational, gyrational, or vertical centrifugal finishing elements, and which may embody all the best features of existing rotatable self-separating finishing machines having the feature of automatic media return and automatic parts exit, while at the same time eliminating the shortcomings thereof. To provide a novel self-separating finishing apparatus having a housing which is rotatable from a first and finishing position to a second and media-separating position and also to a third and parts-ejection position. To provide such a machine wherein vibratory means, preferably variable-intensity vibratory means, is operatively associated with a foraminous member for vibration of said foraminous member, especially at different intensities, when the rotatable housing of such finishing machine is in different positions of rotation. To provide such a machine embodying a particularly advantageous type of variable-intensity vibratory motor especially adapted for use in such machine, particularly such a variable-intensity vibratory motor wherein the intensity of the vibrations imparted thereby is dependent upon its direction of rotation or revolution. To provide a finishing machine in which the separation of finished parts from media and exit of finished parts may be rapidly and efficiently carried out without the intervention of human labor. To provide a rapid and efficient finishing machine from which finished parts or workpieces, essentially free of finishing media, can be rapidly and efficiently exited at a predetermined intensity of vibration. To provide a rapid and efficient finishing machine in which finished parts or workpieces can be rapidly and efficiently separated from finishing media prior to discharge of finished parts therefrom. To provide such a machine wherein the separation of finished parts from finishing media is carried out under the influence of predetermined vibrations in a first position of rotation of the housing of such machine, and the exit of finished parts from such machine under the influence of a predetermined intensity of vibrations in a different position of rotation of said housing. To provide such a machine wherein the intensity of vibrations imparted to the machine and a foraminous member therein in a media-separation phase or cycle is different from the intensity of vibrations imparted during a parts-exit phase or cycle. To provide an improved automatic, semi-automatic, or batch wise finishing machine with automatic separation of finished parts, after automatic separation of finishing media from said finished parts, a combination which has not heretofore been available. To provide a method of finishing involving the impartation of various intensities of vibrations at different stages of the finishing process, for example, during the media-separation and parts-exit stages, e.g., when the housing of the machine in which such method is carried out is in different positions of rotation. Additional objects will be apparent to one skilled in the art, and still other objects will become apparent hereinafter.

The foregoing and additional objects are achieved by provision of the novel finishing apparatus and method of the present invention.

SUMMARY OF THE INVENTION

The invention, in summary, representatively includes the following:

A finishing machine for finishing the surface of unfinished parts with finishing media comprising a housing which is rotatable about a substantially horizontal axis, a finishing chamber in said housing for receiving unfinished parts and finishing media and for finishing of parts when said housing is in a first and finishing position, a storage chamber in said housing adapted to receive finishing media from said finishing chamber, a foraminous member disposed in said housing for separating finishing media from parts, parts exit means adjacent said foraminous member for exit of finished parts from said machine, means for rotating said housing about a substantially horizontal axis, and means for transfer of finishing media from said storage chamber to said finishing chamber, characterized in that said machine comprises a housing which is rotatable to a second and media-separation position and to a third and parts-ejection position, said positions being independent positions, and in that said means for rotating said housing comprises means for rotating said housing to each of said positions; such machine having vibratory means operatively associated with said foraminous member and operative to impart vibrations to said foraminous member when said housing is in different positions of rotation; such machine wherein said vibratory means is adapted to impart different intensities of vibration to said foraminous member when said housing is in different positions of rotation; such machine including control means for varying the intensity of the vibrations imparted by said vibratory means when said housing is in different positions of rotation; such machine wherein said vibratory means comprises a variable-intensity vibratory motor; such machine wherein said vibratory means comprises a vibratory motor having a central shaft carrying eccentric weights at each end thereof; such machine wherein said vibratory motor is reversible and the intensity of the vibrations imparted thereby is dependent upon its direction of revolution; such machine wherein said vibratory motor is reversible and comprises a central shaft with primary eccentric weights at each end thereof fixedly secured to said shaft, and secondary eccentric weights at each end thereof rotatably secured to said shaft and being movable into a position of coincidence with said primary weights and into a position out of coincidence with said primary weights, and limit means defining the degree of permissible rotation for said secondary weights for moving into and out of coincidence with said primary weights; such machine wherein said limit means comprises first limit means defining a position wherein said secondary weights are essentially in coincidence with said primary weights and second limit means defining a position wherein said secondary weights are up to approximately 180 degrees opposed to said primary weights; such machine including control means for reversing said eccentric motor thereby to change the position of said secondary weights with respect to said primary eccentric weights; such machine wherein said vibratory means is also operatively associated with said transfer means for imparting vibrations thereto for assisting with return of finishing media from said storage chamber to said finishing chamber; such machine wherein said transfer means comprises duct means for directing said finishing media to said finishing chamber or out of said machine; such machine wherein said transfer means comprises duct means including associated internal and external openings and door or damper means for alternatively directing said finishing media either to said finishing chamber or out of said machine; such machine wherein said transfer means comprises duct means and wherein said vibratory means is a variable intensity vibratory motor operatively associated with said duct means; such machine wherein said vibratory motor is so located that its axis of rotation is transverse to the path of travel of said parts as they travel along said foraminous member and out of said parts exit; such machine wherein said parts exit comprises a chute located adjacent said foraminous member; such machine wherein said foraminous member is located in said housing between said finishing chamber and said storage chamber; such machine wherein said foraminous member comprises a screen or grate; such machine wherein the finishing chamber comprises an annular spinner member constituting a lower portion of said finishing chamber and a tub member upwardly arranged with respect to said spinner member and comprising an upper portion of said finishing chamber, said spinner member being adapted to rotate about a generally vertical axis when said housing is in finishing position, and a rotational-motion producing assembly operatively associated with said finishing chamber and comprising rotatable support means for said spinner member adapted to rotate about substantially the same axis as its complementary spinner member when said housing is in finishing position, and associated drive means for rotation of said rotatable support means, whereby said spinner member may be rotated with respect to said tub member for carrying out a finishing operation in said finishing chamber; such machine wherein said finishing chamber comprises an annular sealing member for sealing but rotatable engagement of said spinner member with said tub member; such machine wherein said rotatable support means for said spinner member comprises a shaft journaled in bearings mounted adjacent said spinner member and below said spinner member when said housing is in finishing position and wherein said drive means comprise a motor for driving said shaft; such machine wherein said rotating means include means for rotating said housing to each of said different positions of rotation and control means for controlling said rotating means; such machine wherein said housing rotational means comprise hydraulic means; such machine including reversing means for said variable-intensity vibratory motor and control means for controlling said housing rotating means and wherein said motor-reversing means and said rotation-control means are interconnected so as to impart a predetermined intensity of vibrations to said foraminous member at pre-selected positions of rotation of said housing; such machine wherein said housing rotational means comprise hydraulic means; and such machine wherein said housing is optionally but preferably resiliently mounted; such machine wherein said vibratory motor is located above the foraminous member when the housing is in the second or media-separation position; such machine wherein said vibratory motor is located on the same side of the housing as the parts exit; also, the method of finishing parts with finishing media in a finishing machine comprising a housing which is rotatable about a substantially horizontal axis and which has a finishing chamber in said housing and a media storage chamber in said housing and a foraminous member disposed therebetween, and first, second, and third positions of rotation, which positions are different from each other, comprising the steps of finishing said parts in said finishing chamber when said housing is in a first and finishing position, rotating said housing to a second and media-separation position, imparting vibrations of preselected intensity to said foraminous member while said housing is in said media-separation position for separation of media from parts, rotating said housing to a third and parts-ejection position, and imparting vibrations of a preselected intensity to said foraminous member while said housing is in said third and parts-ejection position for ejection of said parts from said machine; and such method wherein said vibrations of preselected intensity are of different intensities in said media-separation and said parts-ejection positions.

DESCRIPTION OF PREFERRED EMBODIMENTS OF THE INVENTION

The invention, in several preferred embodiments, is illustrated by the accompanying drawings, in which.

SPECIFIC REFERENCE TO THE DRAWINGS

Reference is now made to the accompanying drawings for a better understanding of the invention, wherein all the essential parts are numbered and wherein the same numbers are used to refer to corresponding parts in all of the drawings. Although the drawings all relate to the preferred single-stage form of the invention, it will be clear to one skilled in the art that the invention and the principles thereof are equally applicable to multi-stage apparatus of the type disclosed in my copending application and in previously-identified patents.

Figures 1, 2, 5:
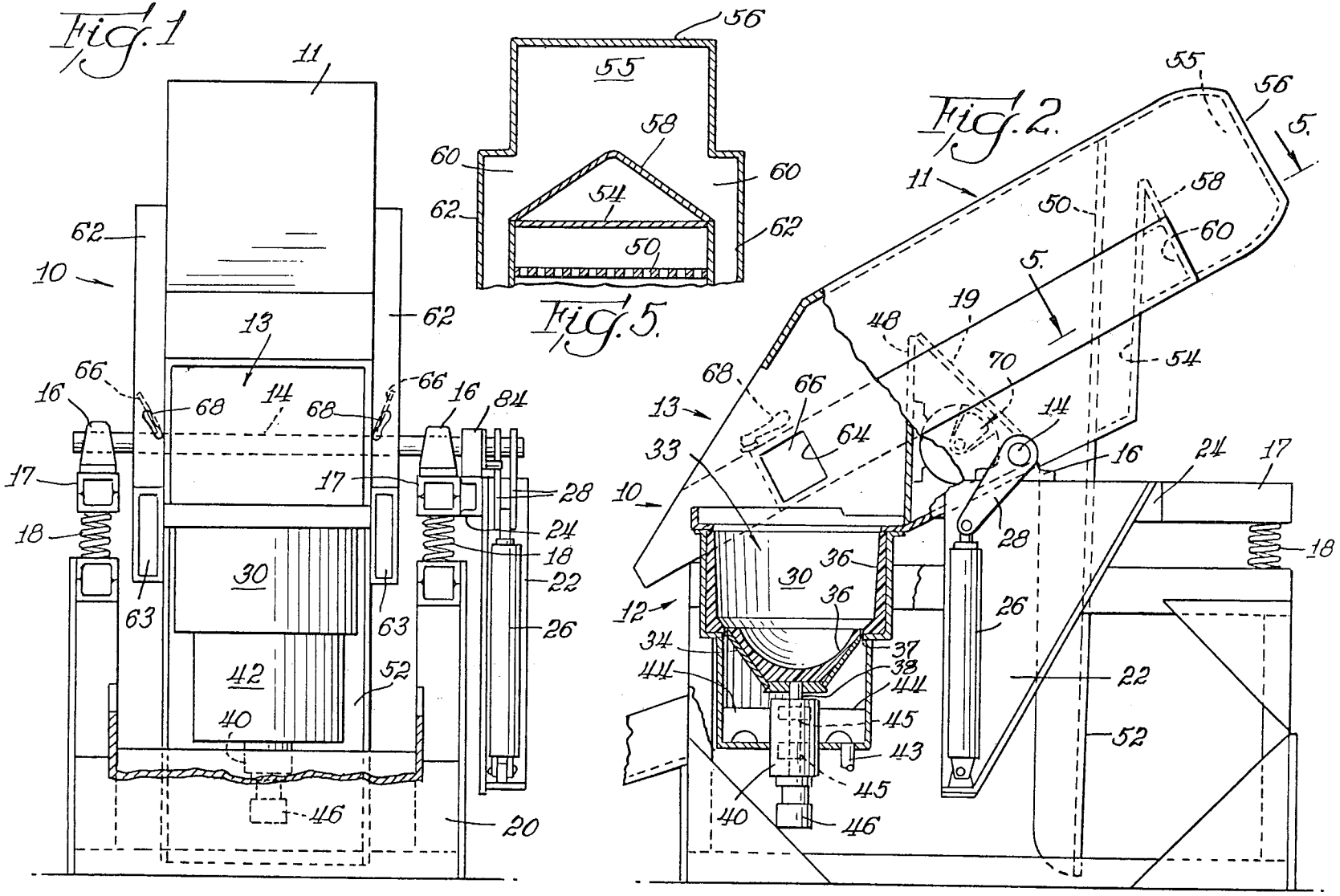
FIG. 1 is a front elevation of a machine according to the present invention.
FIG. 2 is a side view of the machine of FIG. 1, partially in section.
FIG. 5 is a section taken along line 5—5 of FIG. 2.

In the preferred single-stage form, the finishing machine of the invention is shown in elevation in FIG. 1. The finishing apparatus of the invention is shown generally at 10 and, as depicted, is a vertical self-separating centrifugal or spinner-type finishing apparatus with automatic media return. The centrifugal finishing segment of the apparatus is shown generally at 12. For purposes of this invention, it may equally well be replaced by a vibratory or gyratory finishing unit of the type now well-known in the art and depicted in previously-identified United States patents, although a centrifugal finishing segment as shown generally at 12 is preferred. The major portion of the apparatus comprises housing 11 which is rigidly affixed, by weldments assisted by reinforcing plates 19, to horizontal shaft 14, which is rotatably mounted in bearing blocks 16 resiliently mounted on springs 18 between upper frame portion 17 and lower base number 20. Attached to upper frame portion 17 is channel piece 24, which spaces cylinder mounting bracket 22 outwardly at one side of base 20. Rigidly mounted on said bracket 22 is cylinder 26 and associated arm 28 rigidly secured to shaft 14 for rotating housing 11 and its components about a substantially horizontal axis from a first and finishing position to a second and media-separation position and to a third and parts-ejection position, and vice versa. As shown in FIG. 1, a forward opening 13 in housing 11 permits introduction of parts to be finished and ducts 62 are located at both sides of the housing, having duct exterior openings 63 for exit of finishing media from the unit when desired. Interior of duct 62 is damper 66 controlled by handle 68 for optional return of finishing media from storage chamber 55 along ducts 62 and out duct interior openings 64 into finishing chamber 33 of centrifugal finishing segment 12, or for exit from the device through duct exterior openings 63, as desired. As shown, centrifugal finishing segment 12 comprises tub portion 30, cylindrical housing 42 and plates 44 for support of bearing housing 40 and bearings 45 therein, with spinner bowl 34 being mounted on shaft 38, journaled in bearings 45, and centrifugal electric motor 46 for rotation of shaft 38 and powered from a source not shown.

As shown in FIG. 2 in finishing position with finishing segment 12 vertically situated for a finishing operation, finishing chamber 33 comprises annular tub portion 30 and annular spinner bowl 34, both lined as usual with polyurethane or other elastomer 36, and having a suitable seal 37 at their juncture. An especially suitable type of seal is disclosed in U.S. Pat. No. 4,177,608, issued Dec. 11, 1979. Fluid passing seal 37 during the finishing operation collects in the bottom of cylindrical housing 42 and is discharged from the machine via drain 43.

All of the other previously-identified elements are also apparent and, in addition, bottom 56 of separation segment, which defines the bottom of storage compartment 55 therein, crown or V-shaped baffle 58 with associated plate 54 for directing finishing media from storage chamber of compartment 55 into duct openings 60, ducts 62, foraminous member, i.e., screen or grate 50, and directional plate 48 for directing parts and media, upon rotation of the housing, from the finishing chamber 33 onto foraminous member 50. These elements are also visible in the section view of FIG. 5. Also shown is duct internal opening 64 associated with damper 66 and external handle 68 for directing finishing media from storage chamber 55 back into finishing chamber 33 via duct 62. Mounted on directional plate 48, external of the housing, but adjacent foraminous member 50 and exit chute 52, is vibratory electric motor 70, powered from a source not shown, which preferably and advantageously has its axis of rotation tranverse to the parts exit path defined by parts exit chute 52. The vibratory motor 70 is thus associated with foraminous member 50 for assisting separation of finishing media from finished parts when the housing 11 is rotated to the second and media-separation position shown in FIG. 3, and for assisting travel of finished parts, free of finishing media, along said foraminous member and out of said parts exit chute 52 when the housing 11 is rotated to the third or parts-exit position shown in FIG. 3. As will be noted, vibratory motor 10 is preferably located above foraminous member 50 when housing 11 is in media-separation position and is likewise preferably located on the same side of the housing as parts exit chute 52. Other vibratory, including oscillatory and reciprocatory, means can be employed, so long as said means is operatively associated with the foraminous member and capable of accomplishing this same result. For example, an ordinary electric motor may be employed to impart vibrations to foraminous member 50, which may be hinged at one end to housing 11, by means of a simple cam or offset disc and arm arrangement, whereby vibrations are imparted to the foraminous member 50 in the manner of a usual "shaker screen". Alternatively, other arrangements for imparting vibrations to the foraminous member 50, when the housing 11 is rotated to media-separation or parts-exit position as respectively shown in FIGS. 3 and 4, may be employed.

Figure 3:
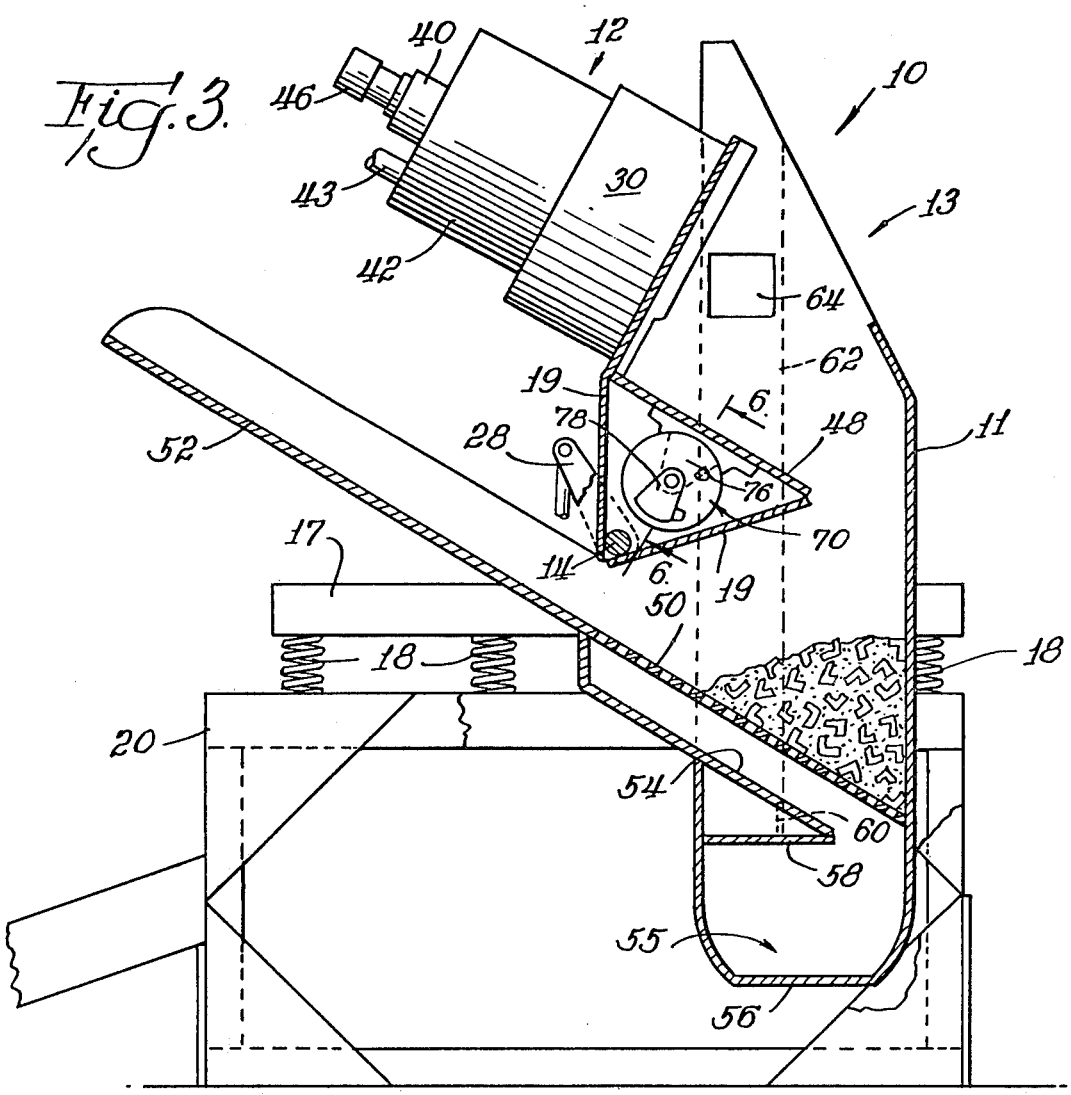
FIG. 3 is another side view, partially in section, but with the machine of the invention rotated to media-separation position.

Upon completion of a finishing cycle with the housing 11 in first and finishing position as shown in FIG. 2, the housing is rotated to second and media-separation position, as shown in FIG. 3, by simply rotating housing 11 on its horizontal axis by means of shaft 14, cylinder 26, and arm or crank 28. AS shown in FIG. 3, in media-separation position, foraminous member 50 is upwardly inclined, thereby creating a pocket in housing 11 atop foraminous member 50 and directly above plate 54 and storage chamber 55, which now constitutes the downward portion of the housing, with bottom 56 defining the bottom of said storage compartment 55. Vibratory motor 70 is shown secured to directional plate 48 external of housing 11 and adjacent foraminous member 50 for assisting separation of finishing media from finished parts. As shown, the axis of rotation of vibratory motor 70 is transverse to the path of travel of parts along foraminous member 50 and out exit chute 52 when housing 11 is further rotated to the third and parts-exit position shown in FIG. 4.

Figure 4:
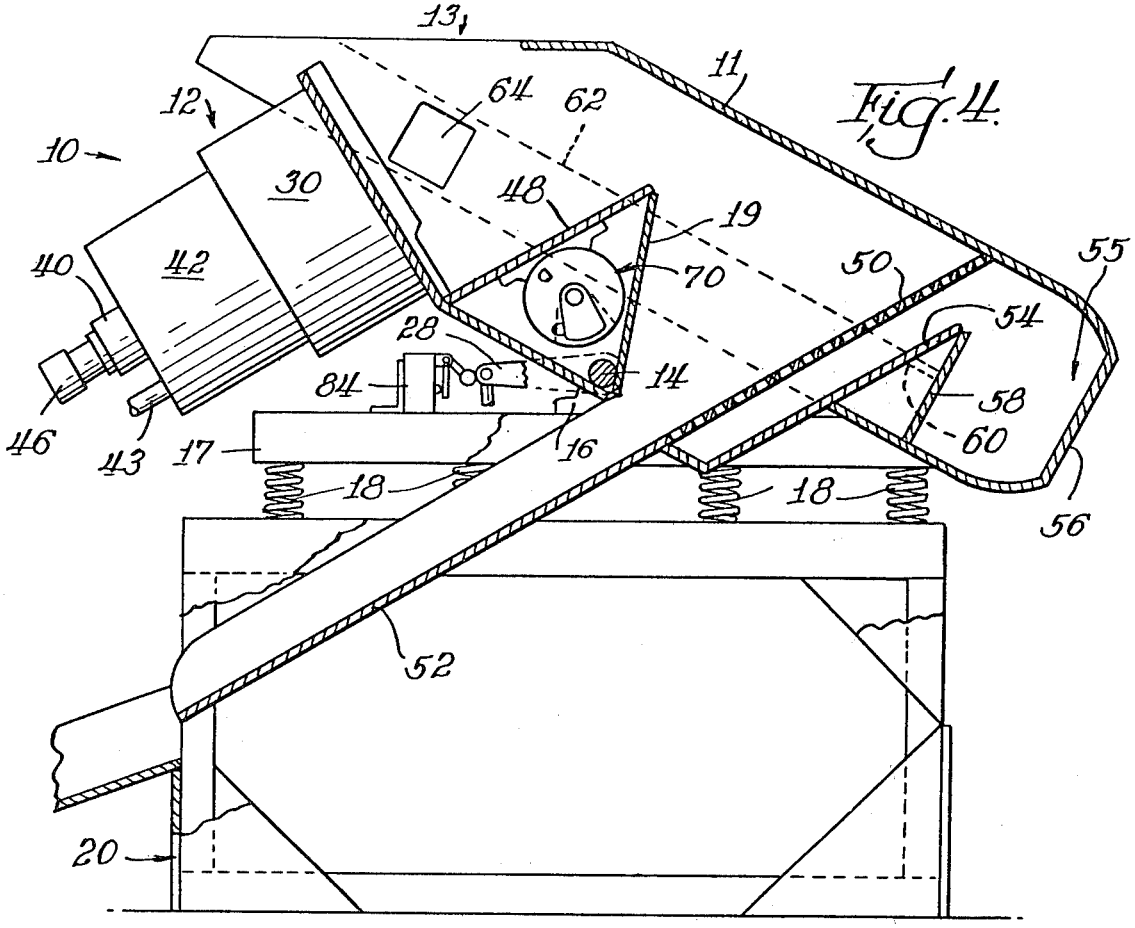
FIG. 4 is another side view, partially in section, of the machine of FIG. 1, but now rotated to a finished parts-ejection or discharge position.

In FIG. 4 housing 11 is shown rotated to the third or parts-exit position, in which parts-exit chute 52 is shown downwardly inclined from the horizontal, foraminous member 50 being likewise inclined at the same angle. Also shown in FIG. 4 in contact with crank or arm 28 is switch 84, the operation of which will be discussed further hereinafter in connection with FIG. 9.

Figure 6:
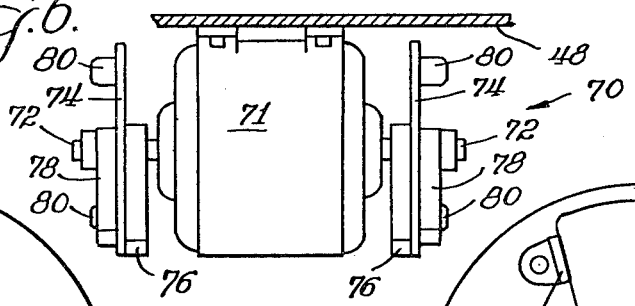
FIG. 6 is a section taken along line 6—6 of FIG. 3.
Figure 7:
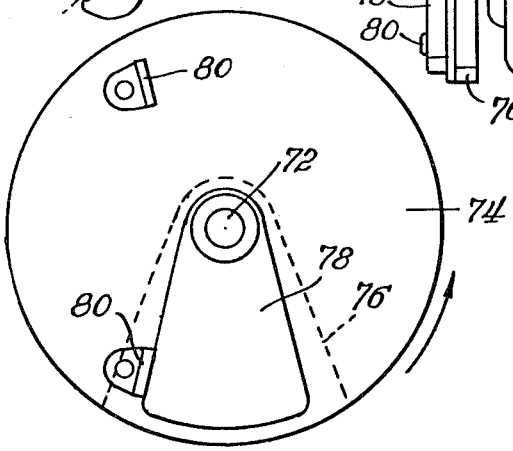
FIG. 7 is an end view of FIG. 6 showing details of the variable-intensity vibratory unit.
Figure 8:
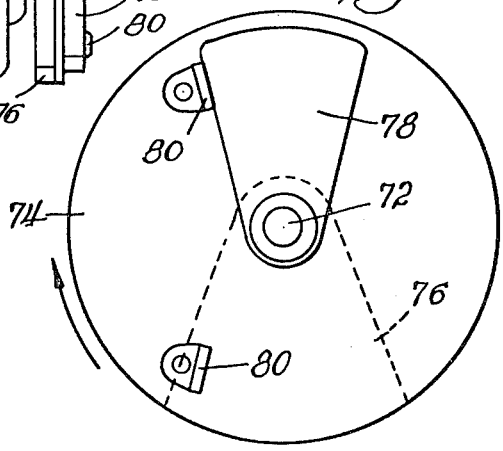
FIG. 8 is the same as FIG. 7 showing the changed position of a secondary eccentric weight upon reversal of the vibratory motor.

Referring now to FIG. 6, details of vibratory motor 70 are shown therein, comprising the motor proper 71 having shaft 72 protruding therefrom at both ends, with primary weights 76 and mounting plates or discs 74 rigidly or fixedly attached to shaft 72 at both ends. The eccentric weights 76 are therefore stationary weights. Also shown are secondary, free or rotatable, eccentric weights 78 secured to shaft 72 by a collar, which are free to rotate about shaft 72 from one position to another. Also shown in FIG. 6, but better shown in FIGS. 7 and 8, are limit means or stops 80 at both ends of the vibratory motor unit, mounted on their respective discs 74, which restrain the movement of the free or rotatable weights 78 about shaft 72. As shown in FIG. 7, free weights 78 are in essential coincidence with fixed weights 76, whereas in FIG. 8 the free weights 78 are rotated into positions out of coincidence with primary or fixed weights 76, the degree of permissible rotation for these free or secondary weights being defined by the limit means 80 on each of the discs 74, as shown these limit means defining a position wherein said secondary or free weights are in approximate coincidence with fixed or primary weights 76 or, upon reversal of the motor, approximately 180 degrees opposed to said primary weights and on the opposite side of shaft 72 therefrom. Thus, by reversing the motor, secondary weights 78 are either brought into coincidence with primary weights 76 for engendering an increased intensity of vibrations or, alternatively, upon reversal of the direction of rotation of the motor, they are approximately 180 degrees opposed to the primary weights, thus diminishing the force of the vibrations and resulting in a decreased intensity of vibrations. According to this embodiment, it is a simple matter to reverse motor 71 to provide either an increased intensity of vibrations or a diminished intensity of vibrations, as desired, depending upon the rotative position of housing 11, whether in first and finishing position, second and media-separation position, or third and parts-exit position, and depending of course upon the type and nature of the parts being finished.

As shown in FIG. 1, secondary weights 78 are depicted in approximate coincidence with primary weights 76 for maximum intensity of vibrations for bringing finishing media from storage chamber 55 through chutes 62 into finishing chamber 33 with maximum speed and efficiency. Conversely, as shown in FIG. 3, secondary eccentric weights 78 are shown out of coincidence with primary weights 76, and approximately 180 degrees opposed thereto, for purposes of imparting gentle vibrations to the mass of finishing media and parts, which in this case may be assumed to be fragile and subject to damage, for purposes of effecting a gentle separation of finishing media from parts in the second and media-separation position of housing 11. Proceeding to FIG. 4, secondary weights 78 are again shown in approximate coincidence with primary weights 76, for purposes of effecting most rapid parts-exit and discharge, after being freed of finishing media, along foraminous member 50 and out parts exit chute 52. In the case of non-fragile parts and hard parts which are not readily subject to damage, it should be clear that secondary weights 78 and primary weights 76 could be maintained in coincidence at all stages whereas, with frangible and readily-damaged parts, secondary weights 78 could be maintained in all stages out of coincidence with primary weights 76 and approximately 180 degrees opposed thereto for imparting minimum intensity of vibrations during media-separation and parts-exit phases or stages, although perhaps maximum intensity vibrations would be desired in the first or finishing position for most rapid and efficient return of finishing media from the storage chamber 55 to finishing chamber 33 along duct 62. Still alternatively, it is apparent that any combination of settings of secondary weights 78 and primary weights 76 for minimizing or maximizing the intensity of vibrations at any of the finishing, media-separation, and parts-exit stages may be employed as desired.

Figure 9:
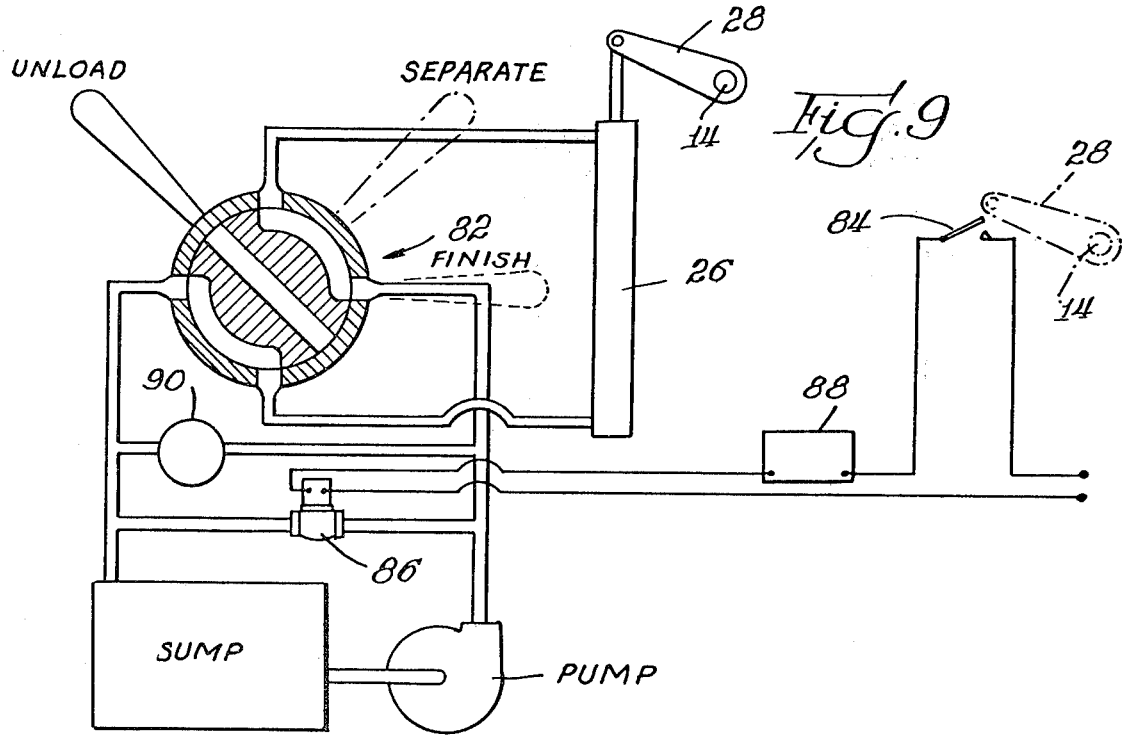
FIG. 9 is a diagram showing one form of control system which may be employed for control of the operation of the machine.

In FIG. 9 is shown a diagram of a control system for controlling the operation of a machine according to the invention, in this case of a hydraulic nature in combination with electrical means, which may also be employed in combination with means for reversal of a vibratory motor, the intensity of the vibrations of which is dependent upon the direction of its rotation. There is first shown control valve 82, having the three positions of "finish", "separate", and "unload", equivalent respectively to first and finishing position, second and media-separation position, and third and parts-exit position of the housing. The control valve 82 is shown in position to rotate the housing from media-separation or second position to parts-exit or third position. As housing 11 rotates from media-separation position, as shown in FIG. 3, to parts-exit or "unload" position, as shown in FIG. 4, crank or arm 28 activates switch 84, opening solenoid valve 86, permitting hydraulic fluid to bypass valve 82 and thus stopping the descent of cylinder 26 until time-delay device 88 opens, whereupon cylinder 26 continues to retract. Such retraction continues to the fullest extent possible, the hydraulic fluid passing through release valve 90. An operator, alerted by cessation of noise from pressure release valve 90 when fluid movement has ceased, may then move the control handle on valve 82 to "finish" position to maintain the housing in that position. After reloading and completion of a finishing cycle, the operator may move the control handle to the vertical or "separate" position and, if desired, reverse motor 71. In such embodiment, it will be apparent that switch 84 is a one-way toggle switch, which actuates solenoid 86 and time-delay 88 only when arm or crank 28 is moving downwardly.

In operation, parts or work pieces to be finished and loose aggregate finishing media are introduced in suitable proportions and, if desired, along with suitable finishing compound, either liquid or solid or both, into opening 13 of housing 11. Actuation of motor 46 causes rotation of shaft 38 in bearings 45 with concurrent rotation of spinner bowl 34, which causes integral admixture and relative movement between parts or work pieces to be finished and finishing media, both on a micromolecular and macromolecular scale. After completion of the finishing cycle, cylinder 26 is activated by moving control valve 82 to the separate position to cause extension of arms 28 and rotation of shaft 14 within bearing block 16 and consequent rotation of housing 11 to the second or media-separation position shown in FIG. 3. With the housing in this position, vibratory motor 70 is actuated, causing vibrations to be transmitted to foraminous member 50, with the consequence that the media and parts are separated, the media falling through foraminous member 50 into storage chamber 55. Depending upon the nature and type of the parts being finished, in this stage vibratory motor 71 will operate either in one direction or the other, to impart most intensive vibrations or least intensive vibrations to foraminous member 50. For certain types of parts, most intense vibrations will be desirable for rapidity and economy of media-separation whereas, for other types of parts, least intense vibrations will be desired to effect the media-separation in as gentle a manner as possible. After media-separation is complete, further rotation of shaft 14 and consequent rotation of housing 11 to third and parts-exit or "unload" position may be effected by moving control valve 82 to the unload position, causing housing 11 to rotate to the parts-exit position shown in FIG. 4. With the housing in this position, vibratory motor 70 is again actuated, the determination as to whether the vibrations imparted to foraminous member 50 shall be more or less intense depending again upon the type and nature of the parts being finished. When the parts are not fragile and susceptible of damage, motor 71 can be switched to the position in which most intense vibrations are imparted to foraminous member 50 for most rapid and economical unloading of the machine and shortening of the cycle. When the parts are fragile and readily susceptible to damage, the direction of rotation of the motor 71 will be switched to that direction which imparts the minimum vibrations to foraminous member 50 and also incidentally to exit chute 52, to minimize the possibility of damaging the parts although the cycle may be somewhat prolonged, the intensity of the vibrations imparted in any case being dependent upon the direction of rotation of motor 71.

After allowing a suitable period for exit of finished parts from the machine via exit chute 52, the cylinder 26 is actuated in reverse to the maximum, thereby returning housing 11 to the first and finishing position as shown in FIG. 1. As already stated, this can conveniently be effected by means of intercooperation between arm 28, switch 84, solenoid 86, time-delay 88, pressure release valve 90, and control valve 82, so that a limited time is permitted for the parts-exit cycle with the housing returning to the first and finishing position after a predetermined delay. Alternatively, such delays may be employed together with suitable switching to maintain the housing 11 in first or finishing position for a predetermined period, then move it to the second or media-separation position for a predetermined period, then to the parts-exit or unload position for a predetermined period, and then back to the first and finishing position for a predetermined period, the entire cycle being repeatable ad infinitum with appropriate relatively simple circuitry. In addition, it is a simple matter to connect motor 71 by means of suitable wiring to the circuit involving delay 88, as shown in FIG. 9, so that the motor will be activated after suitable delays in the various positions of rotation of the housing. Further, in addition, it is a simple matter to introduce into such wiring and delays a reversing control, so that the electric motor 71 is operated with different degrees of intensity of vibration at the different positions of rotation. For example, it is a simple matter to interconnect the revsersing means for the variable-intensity vibratory motor and the control means for controlling said housing rotating means so that a predetermined intensity of vibrations is imparted to the foraminous member at pre-selected positions of rotation of said housing and after pre-determined delays. Thus, for example, the program can be readily set for a certain period of operation of vibratory motor 71 at first or finishing position to return finishing media from storage chamber 55 along ducts 62 and into finishing chamber 33, followed by a suitable period of operation of motor 46 for carrying out the finishing operation after a suitable delay to permit introduction of unfinished parts into finishing chamber 33 via opening 13. The machine can then be programmed, after a suitable period of finishing, to rotate the housing to the second or media-separation position and the vibratory motor to operate for a predetermined period at low or high intensity vibrations, as the case may be. After a suitable delay in second and media-separation position, the housing can be rotated to third and parts-exit position, automatically activating vibratory motor 71 to the same or a different degree of intensity of vibrations for exit of finished parts for a predetermined period. After a further suitable delay in third or parts-exit position, as governed by time-delay 88, for example, the housing 11 may be rotated back to first and parts-finishing position and the vibratory motor 71 again actuated at maximum intensity for return of finishing media to finishing chamber 33, and the entire operation repeated ad infinitum as desired, with only the intervention of manual labor or an automatic feed for the introduction of new unfinished parts into the finishing chamber 33 through opening 13 at suitable intervals.

For example, by appropriate interconnection of the system shown in FIG. 9 with appropriate timing, delay, and motor-reversing elements, a representative program for a machine of the invention is as follows:

In position 1: motor at intense vibrations to transfer finishing media back to finishing chamber from storage chamber—three minutes; delay for automatic or manual reload—fifteen minutes; actuation of spinner motor 46—thirty minutes to ten hours for finishing; rotate housing to position 2.

In position 2: motor reverse for mild intensity of vibrations for three minutes for separation of finishing media from finished parts; rotate to position 3.

In position 3: reverse motor for intense vibrations for three minutes for unloading or discharge of finished parts; rotate to position 1.

Repeat the cycle.

In the foregoing specification, although a single-stage machine has been described, it is to be understood that multiple-stage machines are equally adaptable to the present invention and the method of operation herein described, as will be apparent from my copending application previously mentioned and from numerous already-mentioned United States patents in this field. When eccentric weights are referred to herein, this is intended to mean that the weights are away from the center, in this case away from the central shaft 72 as illustrated in FIGS. 6–8. With respect to the axis upon which a spinner member constituting a part of the finishing element of the invention is mounted, this axis is generally vertical. It is usually substantially vertical or substantially normal to the bottom of the finishing chamber in which such spinner member is located. When the bottom of the finishing chamber is not inclined, the axis is usually both substantially vertical and substantially normal to the bottom of the finishing chamber in which located. When the finishing chamber bottom is inclined, it is generally preferred that the axis be substantially normal to the bottom of the finishing chamber section in which the spinner member is located.

As a further general consideration, although it is preferred that the upstanding walls of the finishing chamber define a tub member which is either coaxially or concentrically arranged with respect to its complementary spinner member, it is only necessary that the walls of the finishing chamber define a tub member which is complementarily arranged with respect to its spinner member, so that the combination of spinner member and tub member comprises lower and upper portions of the finishing chamber. To this end, the walls of the tub member need not necessarily be coaxial or even concentric with its respective spinner member and, for certain applications, embodiments wherein the walls of the finishing chamber surrounding its particular spinner member may even advantageously be oval rather than completely annular and in certain cases may be advantageously oval or annular but off-center and not concentric with its complementary spinner member. However, for practical and performance reasons, as indicated in the foregoing, the upper tub member is preferably not only annular but also either coaxial or concentric with its respective lower spinner member.

Although the finishing chamber of the apparatus of the present invention and its component parts, i.e., the lower spinner bowl and the upper tub portion thereof, are always generally "annular", as is any surrounding or defining wall thereof, it is not essential that such wall or chamber or part thereof be annular in any precise circular sense of the term. It is only necessary that the finishing chamber, any such part thereof, or any such defining or surrounding wall be generally annular, that is, insufficiently cornered so as to prevent the free flow of finishing media and parts to be finished therein in and around the interior of the finishing chamber. For example (except at the juncture of the lower spinner bowl and the upper tub portion, where the annular periphery of the rotatable spinner bowl lies in opposed facing relationship to the annular lower edge of the nonrotatable tub portion, and where both must obviously be annular to permit the necessary spinner bowl rotation), such generally-annular finishing chamber, especially upper tub portion thereof and any surrounding or outer or defining wall thereof, may have a decagonal, octagonal, hexagonal, or pentagonal cross-section, or any other somewhat cornered cross-section which does not detract from its generally-annular nature or interfere with the flow of parts and media about the interior of the finishing chamber therein, or with rotation of the spinner bowl about an essentially central and vertical axis. Although for purposes of ultimate convenience and operating efficiency a truly circular annular finishing chamber is preferred, other generally-annular finishing chambers may be employed with equal or only somewhat reduced efficiency, as will be apparent to one skilled in the art.

It is to be understood that the term "finishing media" is used generally herein to designate materials used to impart all types of finishes, including those finishes acquired with abrading material as well as with polishing material, and that polishing, abrading, deburring, edge-breaking, buffing, burnishing, and the like, are as usual only species of finishing. The term "finishing media", as used herein, is also intended to include all such materials which serve as loose, particulate, and solid finishing materials of the type presently employed in the trade and others of a similar nature whether natural of synthetic, including stone, porcelain, abrasive-filled clays, plastics, ceramics, wood, leather, or the like, and in any suitable shape or form as may be employed for the surface refinement and/or deburring of parts or workpieces, which are usually of metal or plastic.

From the foregoing, it will be seen that a novel semi-automatic or batch-type of finishing apparatus which is self-separating and which embodies automatic media return, whereby finishing media may be rapidly separated from finished parts and finished parts rapidly discharged from the machine by vibratory means associated with the foraminous member employed for separating finishing media from finished parts and for parts-exit, having independent positions of the rotatable housing for finishing, media-separation, and parts-exit, and wherein vibratory means for imparting vibrations is operatively associated with the foraminous member for vibration thereof in different positions of rotation of the housing, at the same intensity or optionally at different intensities of vibrations, and such machine embodying a particularly advantageous type of variable-intensity vibratory motor especially adapted for use in such machine, as well as a method of finishing involving the impartation of various intensities of vibration to the foraminous member at different stages of the process, that is, with the housing rotated to different positions for finishing, media-separation, or parts-exit, and which machine can readily be made fully programmable and automatic, and whereby all of the additional objects of the invention may be accomplished, has been provided by the present invention.

It is to be understood that the invention is not to be limited to the exact details of construction, operation, or exact materials or embodiments shown and described, as obvious modifications and equivalents will be apparent to one skilled in the art, and the invention is therefore to be limited only by the full scope of the appended claims.

I claim:

1. The method of finishing parts with finishing media in a finishing machine comprising a housing which is rotatable about a substantially horizontal axis and which has a finishing chamber in said housing and a media storage chamber in said housing and a foraminous member disposed therebetween, and first, second, and third positions of rotation, which positions are different from each other, comprising the steps of finishing said parts in said finishing chamber when said housing is in a first and finishing position, rotating said housing to a second and media-separation position, imparting vibrations of preselected intensity to said foraminous member while said housing is in said media-separation position for separation of media from parts, rotating said housing to a third and parts-ejection position, and imparting vibrations of a preselected intensity to said foraminous member while said housing is in said third and parts-ejection position for ejection of said parts from said machine.

2. The method of claim 1, wherein said vibrations of preselected intensity are of different intensities in said media-separation and said parts-ejection positions.

* * * * *